US005681213A

United States Patent [19]

Hashii

[11] Patent Number: 5,681,213

[45] Date of Patent: Oct. 28, 1997

[54] SANDING TOOL

[75] Inventor: Toshimitsu Hashii, Tsuen Wan, Hong Kong

[73] Assignee: Ryobi Limited, Tokyo, Japan

[21] Appl. No.: 648,372

[22] Filed: May 15, 1996

[30] Foreign Application Priority Data

May 16, 1995 [JP] Japan ..... 7-117336

[51] Int. Cl.[6] ..... B24B 23/00; B24B 27/08

[52] U.S. Cl. ..... 451/356; 451/344; 451/351

[58] Field of Search ..... 451/344, 351, 451/356, 357, 359, 523, 524, 525, 538, 539, 514, 517, 490

[56] References Cited

U.S. PATENT DOCUMENTS

| | | | |
|---|---|---|---|
| 1,681,648 | 8/1928 | Root | 451/351 |
| 2,350,098 | 5/1944 | Decker | 451/356 |
| 2,786,313 | 3/1957 | Shaff | 451/359 |
| 3,136,099 | 6/1964 | Tully et al. | 451/356 |
| 3,522,681 | 8/1970 | Lampert | 451/490 |
| 4,920,702 | 5/1990 | Kloss et al. | 451/490 |
| 5,056,268 | 10/1991 | Wolff | 451/344 |
| 5,398,454 | 3/1995 | Berner | 451/359 |
| 5,482,499 | 1/1996 | Satoh | 451/356 |
| 5,533,925 | 7/1996 | Sato | 451/344 |

*Primary Examiner*—James G. Smith
*Assistant Examiner*—Derris H. Banks
*Attorney, Agent, or Firm*—Brooks & Kushman P.C.

[57] ABSTRACT

A sanding tool for grinding a workpiece to be worked has a housing in which an electric motor is accommodated and a grinding assembly operatively connected to an output shaft of the electric motor to be swingable to perform a grinding operation, and the grinding assembly comprises a driving plate operatively connected to the output shaft of the electric motor to be swingable, a grinding plate attached to the driving plate to grind the workpiece and a member for operatively connecting the driving plate and the grinding plate such that the grinding plate is changed in an attaching position thereof in a plane parallel to a surface of the workpiece to be ground. First and second engaging members are formed to the grinding plate and the driving plate, respectively, for achieving an engagement therebetween when the grinding plate is pushed against the driving plate, and when the first and second engaging members are engaged, the rotational motion of the grinding plate to the driving plate is restricted.

13 Claims, 3 Drawing Sheets

SANDING TOOL

BACKGROUND OF THE INVENTION

The present invention relates to a sanding tool and more particularly to a grinding plate mounting mechanism of a sanding tool.

A sanding tool generally has a structure in which a shaft supporting a grinding member is journaled in a front portion of a shaft case and an output from a motor as a driving means disposed in the case is transmitted to the shaft. A motion conversion mechanism for converting a rotational motion of an output shaft of the motor to a swing motion and transmitting the swing motion to the shaft is disposed between the motor and the shaft, whereby the shaft performs a reciprocal angular motion around a central axis of the shaft by this motion conversion mechanism. A grinding member, to which a sand paper is attached, is fixed to the lower end portion of the shaft so as to allow the sand paper to swing together with the grinding member to thereby grind a workpiece to be worked.

In the sanding tool of the general structure mentioned above, however, the grinding working by the grinding member is generally often carried by using only the front end portion thereof, and therefore, the sand paper attached to the front portion is severely worn in comparison with the other portion thereof. In the conventional structure in which the grinding member is fixed to the shaft, it is required to change the sand paper itself even in a case where only its front portion is locally worn, thus being disadvantageous. In addition, in a usual case, since the sand paper is exchanged through a bonding working to a body of the Finding member, the working performance will be adversely lowered through often exchanging workings, also providing a disadvantageous problem.

SUMMARY OF THE INVENTION

An object of the present invention is to substantially eliminate defects or drawbacks encountered in the prior art described above and to provide a sanding tool capable of preventing the grinding member from wasting and improving the grinding efficiency of the sand tool.

This and other objects can be achieved according to the present invention by providing a sanding tool for grinding a workpiece to be worked which has a housing in which an electric motor is accommodated and a grinding means operatively connected to an output shaft of the electric motor to be swingable to perform a grinding operation, the grinding means comprising:

a driving plate operatively connected to the output shaft of the electric motor to be swingable;

a grinding plate attached to the driving plate to grind the workpiece; and means for operatively connecting the driving plate and the grinding plate such that the grinding plate is changed in an attaching position thereof in a plane parallel to a surface of the workpiece to be ground.

In a preferred embodiment, the sanding tool further comprises an urging member such as spring for pushing the grinding plate against the driving plate disposed between the grinding plate and the driving plate.

The sanding tool further comprises first and second engaging means formed to the grinding plate and the driving plate, respectively, for achieving an engagement therebetween when the grinding plate is pushed against the driving plate, and when the first and second engaging means are engaged, a rotational motion of the grinding plate with respect to the driving plate is restricted. The first engaging means is composed of a plurality of notches formed to the grinding plate and the second engaging means is composed of a plurality of projections formed to the driving plate at intervals corresponding to location of the notches. In a modification, the first engaging means is composed of a plurality of notches formed to the driving plate and the second engaging means is composed of a plurality of projections formed to the grinding plate at intervals corresponding to location of the notches.

It is desired that the grinding plate has a substantially equilateral triangular configuration.

The swing motion of the driving plate is caused by means of a swing arm operatively connected to the output shaft of the electric motor.

In a more concrete structure, a sanding tool for grinding a workpiece to be worked may comprises:

a housing constituting an outer casing of a sanding tool;

an electric motor which is disposed in the housing and from which an output shaft extends;

a driving shaft operatively connected to the output shaft of the electric motor;

a fulcrum pin operatively supported to the housing to be swingable, the fulcrum pin extending externally of the housing through a retaining hole formed to the housing;

means operatively connected to the drive shaft for giving a swing motion to the fulcrum pin;

a driving plate operatively connected to the fulcrum pin to be swingable thereabout;

a grinding plate attached to the driving plate to grind the workpiece;

means for pushing the grinding plate against the driving plate; and first and second engaging means formed to the grinding plate and the driving plate, respectively, for achieving an engagement therebetween, wherein when the first and second engaging means are engaged, a rotational motion of the grinding plate to the driving plate is restricted.

According to the structure of the sanding tool of the present invention, the grinding plate is separated from the driving plate against the urging force of the spring to thereby release the engagement between the first and second engaging means. Under this condition, the grinding plate is rotated with respect to the driving plate in a plane substantially parallel to the surface of the workpiece to be ground. After rotated, the first and second engaging means are engaged to position the grinding plate and the driving plate in a working position to thereby restrict the rotation of the grinding plate to the driving plate.

Accordingly, when a portion of the grinding plate which is used for the actual grinding operation and worn is changed to a new portion which is less used for the grinding operation, whereby the grinding plate, i.e. such as sand paper can be effectively utilized, improving the working efficiency as well as merit in cost performance.

The nature and further features of the present invention will be made more clear from the following descriptions made with reference to the accompanying drawings.

DESCRIPTION OF THE PREFERRED EMBODIMENT

One preferred embodiment of the present invention will be described hereunder with reference to the accompanying drawings.

Figure 1:
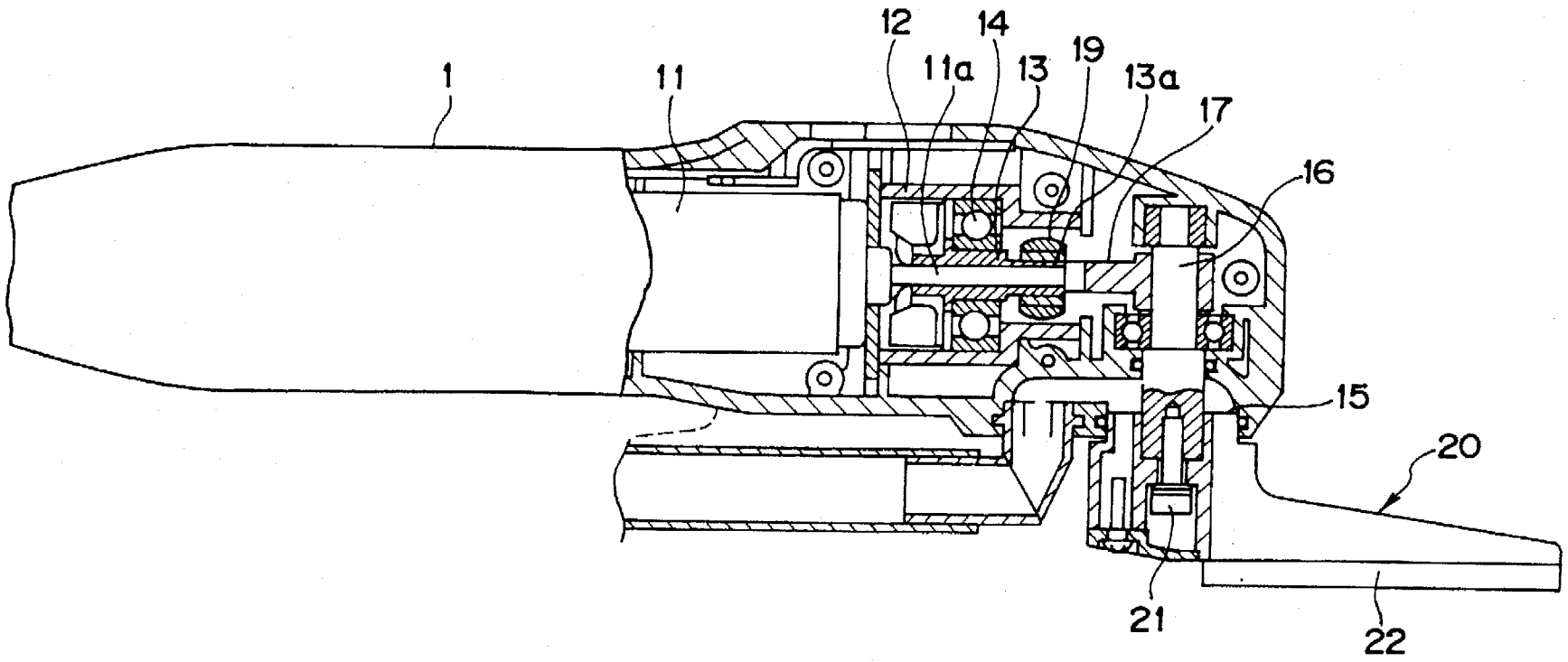
FIG. 1 is a sectional view of a sanding tool according to the present invention as viewed from a side thereof.

A sanding tool shown in FIG. 1 comprises a housing 1 in which a DC motor 11 is accommodated. On an output side of the DC motor 11 is disposed a box 12 including a mechanism for converting a rotational motion of an output shaft 11*a* of the motor 11 to a swing motion. A drive shaft 13 operatively connected to the output shaft 11*a* of the motor 11 is disposed in the box 12 to be rotatable through a bearing means 14. The driving shaft 13 has a front end portion (right side end as viewed) at which is formed an eccentric portion 13*a* eccentric with respect to an axis of the drive shaft 13.

Figure 2:
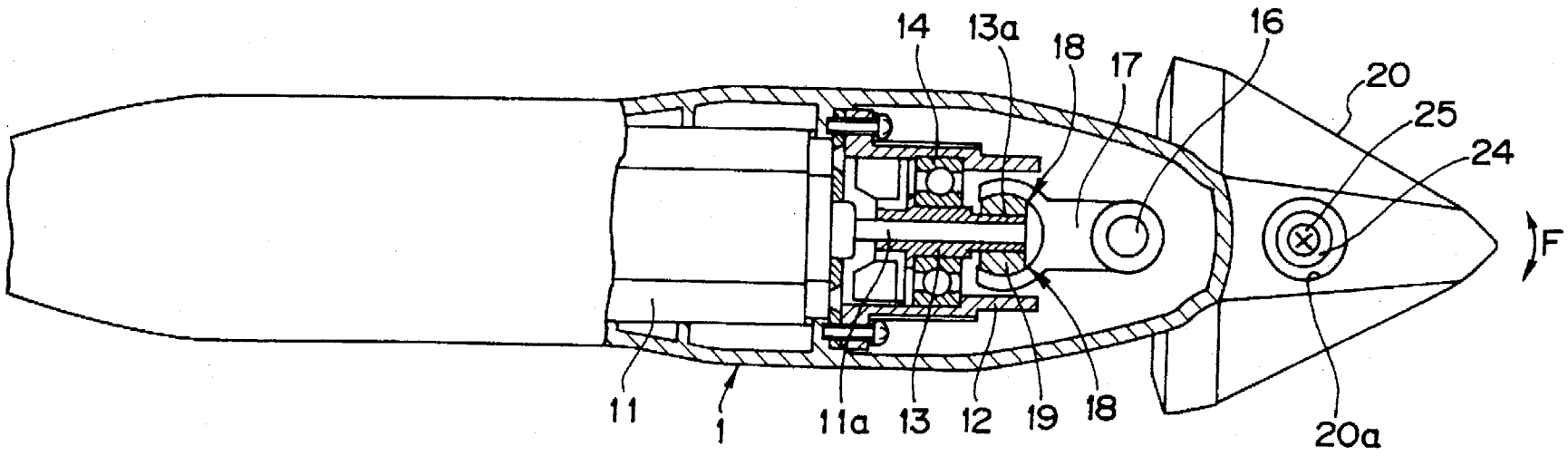
FIG. 2 is a plan sectional view of the sanding tool of FIG. 1.

A fulcrum pin 16 is disposed inside the housing at its front end portion in a manner that the fulcrum pin 16 extends in a direction normal to the driving shaft 13 and projects, to be swingable, at its lower end from a retaining hole 15 formed to the lower surface of the front portion of the housing 1. A swing arm 17 is also disposed in the housing 1 and the swing arm 17 has a base portion fitted fixedly to an upper portion of the fulcrum pin 16. The swing arm 17 is provided with an end portion (left side end as viewed in FIG. 2) which is branched into two circular portions constituting a slide-contact portion 18. Referring to FIG. 2, a slide ring 19 which is engaged with an inside of the slide-contact portion 18 is disposed on an outer peripheral side of the eccentric portion 13*a* of the driving shaft 13.

A driving plate 20 having approximately triangular shape, desirably equilateral triangle, is rotatably supported to the retaining hole 15 formed to the housing 1, and the driving plate 20 has a rotational central portion having a cylindrical structure vertically rising upward as shown in FIG. 1. This cylindrical portion is supported by the inner peripheral surface of the retaining hole 15 to thereby support the driving plate 20 to be rotatable. The driving plate 20 is connected to the lower end portion of the fulcrum pin 16 by means of screw 21 to allow the driving plate 20 to swing in association with the swing motion of the pin 16. A grinding plate 22, to which a sanding paper S for the grinding working is attached, is mounted to the lower surface of the driving plate 20.

Figure 3:
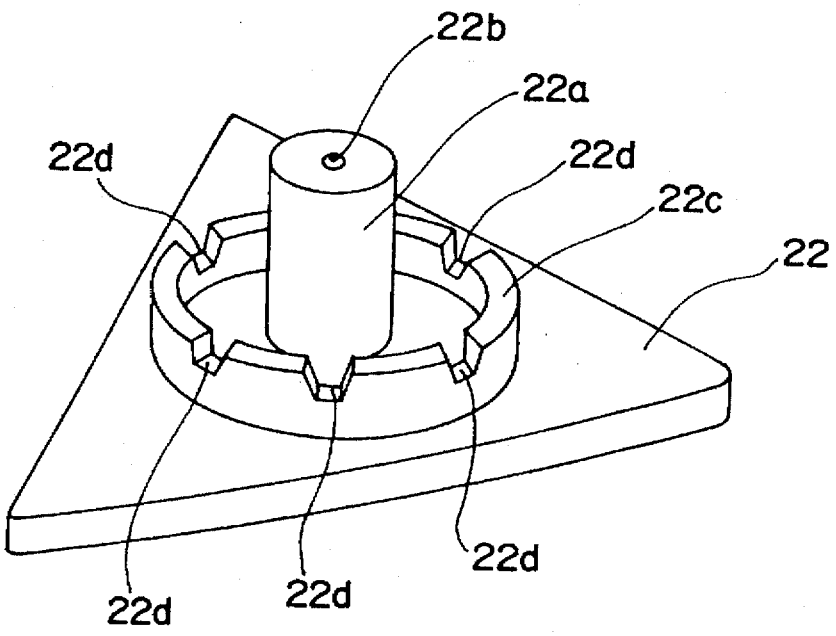
FIG. 3 is a perspective view of a grinding plate used for the sanding tool of the present invention.

The grinding plate 22 is best shown in a perspective view of FIG. 3. The grinding plate 22 has a central boss 22*a* which is formed on the upper surface of the grinding plate 22 so as to project upward, as viewed, and the boss 22*a* is formed with a bore 22*b*. On the upper surface of the grinding plate 22 is also formed a rib 22*c* having a ring-shaped structure, to which a plurality of notches 22*d*, 22*d*, —22*d* are formed.

Figure 4:
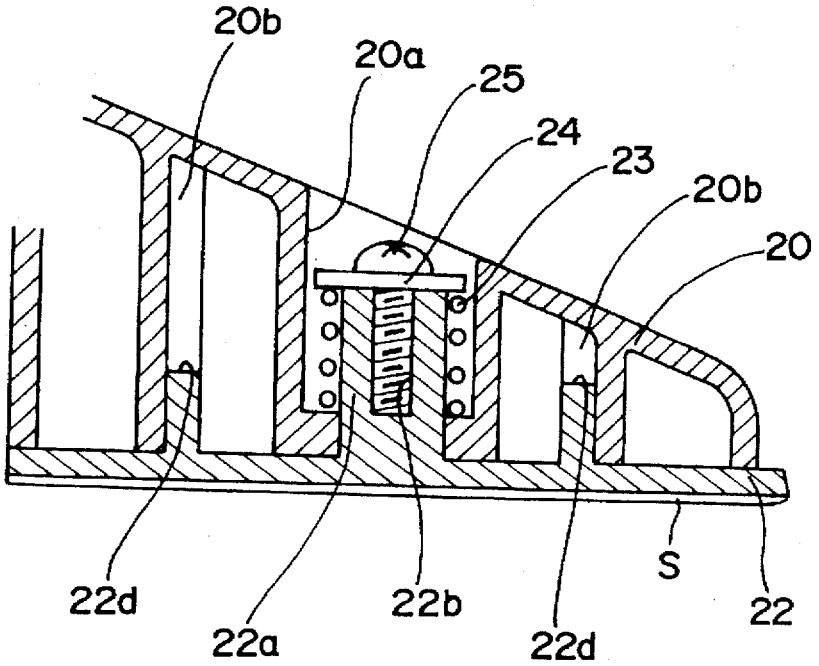
FIG. 4 is a sectional view showing a mounting condition of the grinding plate to a driving plate.

The mounting state of the grinding plate 22 to the driving plate 20 is shown in FIG. 4. The driving plate 20 has a bore 20*a* into which the boss 22*a* of the grinding plate 22 is inserted. A washer 24 is fixed to the upper portion of the boss 22*a* by means of screw 25, the washer 24 has a diameter larger than that of the boss 22*a*, and a spring 23 is interposed between the washer 24 and the driving plate 20 to thereby urge the grinding plate 22 against the driving plate 20 through the washer 24. The driving plate 20 is also formed with a plurality of projections 20*b* at portions corresponding to the notches 22*d* of the ring-shaped rib 22*c* in engagement. When the projections 20*b* are engaged with the notches 22*d*, the rotational motion of the grinding plate 11 with respect to the driving plate 20 is restricted.

The sanding tool of the structure described above will operate in the following manner.

When the DC motor 11 is driven to rotate the driving shaft 13 through the output shaft 11*a*, the slide ting 19 is also rotated in an eccentric manner through the contact to the eccentric portion 13*a* of the driving shaft 13, whereby the swing arm 17 swings about the fulcrum pin 16. The fulcrum pin 16 is then rotated through the swing motion of the swing arm 17, and the driving plate 20 is hence swung in a direction F in FIG. 2 to thereby perform a required grinding working.

In a case where one front (corner) portion of the sanding paper, which is attached to the grinding plate 22 having a triangular structure and which is grinding the workpiece, is worn, with reference to FIG. 4, only the grinding plate 22 is moved downward against the urging force of the spring 23 to thereby release the engagement between the projections 20*b* of the driving plate 20 and the notches 22*d* of the driving plate 22. Under the condition, the grinding plate 22 is rotated with respect to the driving plate 20 so that another front end portion of the sanding paper of the grinding plate 22 is positioned to a portion ready for the next grinding working. After this positioning, the grinding plate 22 is moved upward to engage the projections 20*b* of the driving plate 20 with the notches 22*d* of the grinding plate 22 to thereby restrict the rotation of the grinding plate 22 to the driving plate 20.

According to such a simple working, the front end portions of the grinding plate 22 can be effectively utilized with an improved working efficiency.

In a modification, a plurality of projections may be formed to the grinding plate 22 which is to be engaged with notches formed to the driving plate 20.

The present invention is of course utilized for grinding plate having a shape other than triangular shape.

According to the present invention of the structure described above, when a portion of the grinding plate, which is used for the actual grinding operation and worn, is changed to a new portion which is less used for the grinding operation by merely rotating the grinding plate, whereby the grinding plate, i.e. such as sand paper can be effectively utilized, improving the working efficiency as well as merit in cost performance.

What is claimed is:

1. A sanding tool for grinding a work piece to be worked which has a housing in which an electric motor is accommodated and a grinding means operatively connected to an output shaft of the electric motor to be swingable to perform a grinding operation, said grinding means comprising:

a driving plate operatively connected to the output shaft of the electric motor to be swingable;

a grinding plate attached to said driving plate to grind the work piece;

means for operatively connecting said driving plate and said grinding plate, said means allowing said grinding plate to be changed in an attaching position thereof in a plane parallel to a surface of the work piece to be ground while keeping the driving plate and the grinding plate connected with each other; and means for pushing said grinding plate against said driving plate.

2. A sanding tool according to claim 1, wherein said means for pushing is a spring disposed between said grinding plate and said driving plate.

3. A sanding tool according to claim 1, further comprising first and second engaging means formed to said grinding plate and said driving plate, respectively, for achieving an engagement therebetween when said grinding plate is pushed against said driving plate and wherein when said first and second engaging means are engaged, a rotational motion of the grinding plate to the driving plate is restricted.

4. A sanding tool according to claim 3, wherein said first engaging means is composed of a plurality of notches formed to said grinding plate and said second engaging means is composed of a plurality of projections formed to said driving plate at intervals corresponding to location of said notches.

5. A sanding tool according to claim 4, wherein said grinding plate is formed with a rib to which said notches are formed.

6. A sanding tool according to claim 3, wherein said first engaging means is composed of a plurality of notches formed to said driving plate and said second engaging means is composed of a plurality of projections formed to said grinding plate at intervals corresponding to location of said notches.

7. A sanding tool according to claim 1, wherein said grinding plate has a substantially triangular configuration.

8. A sanding tool according to claim 1, wherein the swing motion of said driving plate is caused by means of a swing arm operatively connected the output shaft of the electric motor.

9. A sanding tool according to claim 1, wherein said grinding plate has a central boss projecting from a surface opposite to a grinding surface of the grinding plate, said central boss being inserted into a bore formed in the driving plate;

and wherein a spring is provided around the central boss inserted into the bore, the spring being compressed by fixing a washer to an end portion of the central boss by a screw to thereby push the grinding plate against the driving plate.

10. A sanding tool for grinding a workpiece to be worked comprising:

a housing constituting an outer casing of a sanding tool;

an electric motor which is disposed in said housing and from which an output shaft extends;

a driving shaft operatively connected to the output shaft of the electric motor;

a fulcrum pin operatively supported to the housing to be swingable, said fulcrum pin extending externally of the housing through a retaining hole formed to the housing;

means operatively connected to said drive shaft for giving a swing motion to said fulcrum pin;

a driving plate operatively connected to said fulcrum pin to be swingable thereabout;

a grinding plate attached to said driving plate to grind the workpiece;

means for pushing said grinding plate against said driving plate; and first and second engaging means formed to said grinding plate and said driving plate, respectively, for achieving an engagement therebetween, wherein when said first and second engaging means are engaged, a rotational motion of the grinding plate to the driving plate is restricted.

11. A sanding tool for grinding a work piece to be worked which has a housing in which an electric motor is accommodated and a grinding means operatively connected to an output shaft of the electric motor to be swingable to perform a grinding operation, said grinding means comprising:

a driving plate operatively connected to-the output shaft of the electric motor to be swingable;

a grinding plate attached to said driving plate to grind the work piece;

means for operatively connecting said driving plate and said grinding plate such that said grinding plate is changed in an attaching position thereof in a plane parallel to a surface of the work piece to be ground; and first and second engaging means formed to said grinding plate and said driving plate, respectively, for achieving an engagement therebetween when said grinding plate is pushed against said driving plate and wherein, when said first and second engaging means are engaged, a rotational motion of the grinding plate to the driving plate is restricted, said first engaging means being composed of a plurality of notches formed to said grinding plate and said second engaging means being composed of a plurality of projections formed to said driving plate at intervals corresponding to the locations of said notches.

12. A sanding tool according to claim 11, wherein said grinding plate is formed with a rib to which said notches are formed.

13. A sanding tool according to claim 12, wherein said first engaging means is composed of a plurality of notches formed to said driving plate and said second engaging means is composed of a plurality of projections formed to said grinding plate at intervals corresponding to locations of said notches.

* * * * *